US007089929B1

(12) United States Patent
Feng

(10) Patent No.: US 7,089,929 B1
(45) Date of Patent: Aug. 15, 2006

(54) SNORKEL MOUTHPIECE SET

(76) Inventor: Li-Jen Feng, No. 22-10, Lane 50, Tian Muu E. Rd., Taipei (TW)

( * ) Notice: Subject to any disclaimer, the term of this patent is extended or adjusted under 35 U.S.C. 154(b) by 0 days.

(21) Appl. No.: 11/110,453

(22) Filed: Apr. 19, 2005

(51) Int. Cl.
*B63C 11/16* (2006.01)
*B63C 11/02* (2006.01)

(52) U.S. Cl. ..... 128/201.11; 128/201.27

(58) Field of Classification Search ..... 128/848, 128/859, 861, 200.29, 201.26, 201.11, 201.27, 128/201.28, 206.29; 405/186, 187
See application file for complete search history.

(56) References Cited

U.S. PATENT DOCUMENTS 4,066,077 A * 1/1978 Shamlian ..... 128/201.11
4,782,830 A * 11/1988 Forman ..... 128/201.11
5,267,556 A * 12/1993 Feng ..... 128/201.11
5,845,635 A * 12/1998 Hermansen et al. ... 128/201.11
6,263,871 B1 * 7/2001 Brown et al. ..... 128/200.29
6,932,085 B1 * 8/2005 Krawczyk et al. ..... 128/204.26

* cited by examiner

*Primary Examiner*—Teena Mitchell
(74) *Attorney, Agent, or Firm*—Pro-Techtor Int'l Services

(57) ABSTRACT

A mouthpiece set of a snorkel including a base, a connector, and a mouthpiece, wherein the base connecting to the snorkel and the connector having an upper end connecting to the mouthpiece and a lower end including a sphere inserted into a concentric hollow cylinders of the base, thereby enabling the mouthpiece rotating freely through the free rotation sphere of the connector.

3 Claims, 2 Drawing Sheets

SNORKEL MOUTHPIECE SET

BACKGROUND OF THE INVENTION (a) Field of the Invention

The present invention relates to a mouthpiece set of a snorkel including a base, a connector, and a mouthpiece, wherein the base connecting to the snorkel and the connector having an upper end connecting to the mouthpiece and a lower end including a sphere inserted into a concentric hollow cylinders of the base, thereby enabling the mouthpiece rotating freely through the free rotation sphere of the connector inside the hollow cylinder.

(b) Description of the Prior Art

A conventional mouthpiece set of a snorkel is of a fixed connection with a base without being able to rotate, which is inconvenient to a diver when moving head.

SUMMARY OF THE INVENTION

The present invention relates to a mouthpiece set of a snorkel including a base, a connector, and a mouthpiece, wherein the base connecting to the snorkel and the connector having an upper end connecting to the mouthpiece and a lower end including a sphere inserted into a concentric hollow cylinders of the base, thereby enabling the mouthpiece rotating freely through the free rotation sphere of the connector inside the hollow cylinder.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
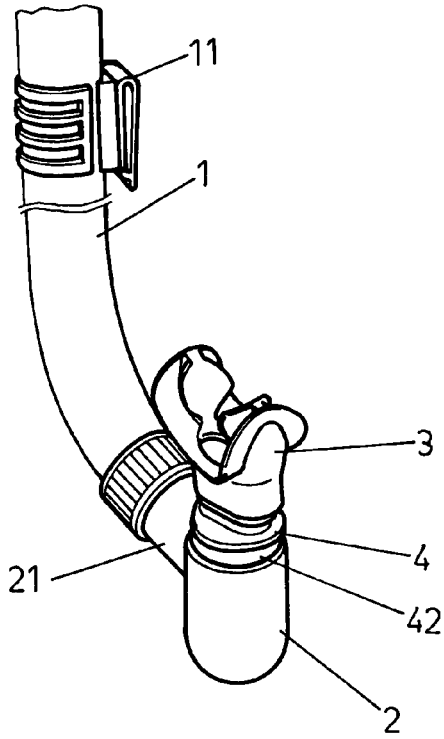
FIG. 1 shows a prospective view of the present invention.
Figure 2:
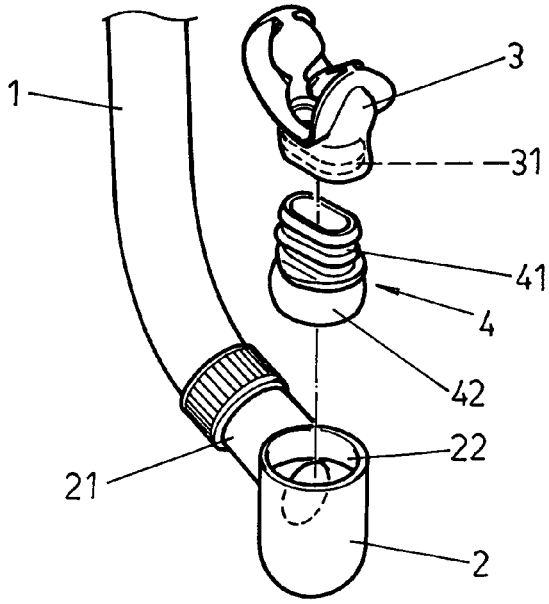
FIG. 2 shows an exploded elevational view of the present invention.
Figure 3:
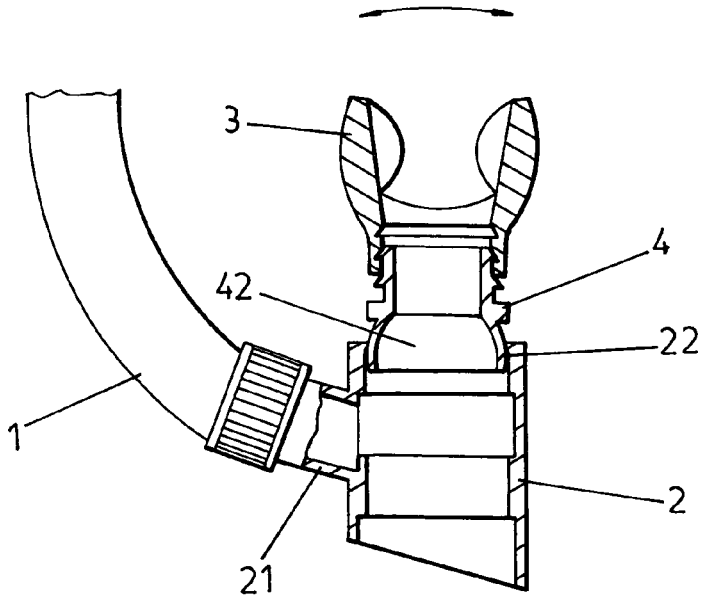
FIG. 3 shows a cross sectional view of the present invention.

Referring to FIGS. 1–3. The present invention relates to a mouthpiece set of a snorkel including a snorkel tube 1, a hollow cylindrical base 2, a mouthpiece 3, and a hollow connector 4 wherein the snorkel tube 1 has a clip 11 for fastening to the mask; the hollow cylindrical base 2 having a closed lower end connecting with the snorkel tube 1 and an open upper end connecting with the mouthpiece 3; the mouthpiece 3 has a corrugated connection 31 for fixing on the hollow connector 4. In one embodiment, the hollow connector 4 has a lower end shaped as a sphere 42, which is fitted into a concentric hollow cylinders 22 of the base 2 to form a ball and socket joint enabling the sphere 42 to rotate freely inside the hollow cylinder 22, and to be angled in any direction relative to the axis of the hollow cylindrical base 2.

Figure 4:
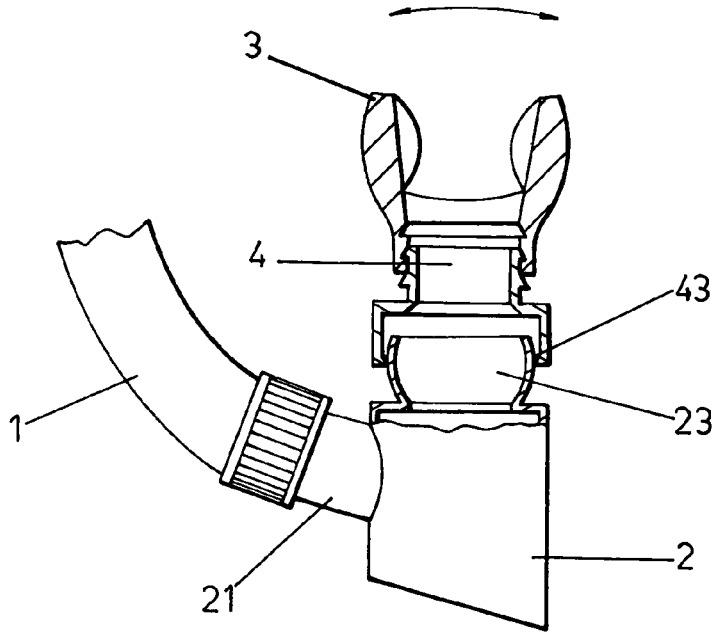
FIG. 4 shows a cross sectional view of an application of the present invention.

For connection of the connector 4 with the hollow cylindrical base 2, another embodiment has the ball and socket joint inverted where the hollow cylindrical base 2 has an upper end shaped as a sphere 23 inserted into a hollow cylinder 43 of the hollow connector 4, thereby forming an "universal joint" mouthpiece, as in FIG. 4, and the third embodiment can be a combination of a cylinder within a concentric hollow cylinder.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A mouthpiece set of a snorkel comprising a snorkel tube;

a hollow cylindrical base connected to a lower end of said snorkel tube, having an axis, a closed lower end, and an open upper end;

a hollow connector having a spherical lower portion, and an upper end portion with at least one corrugation;

a ball and socket joint comprising said spherical lower portion of said hollow connector moveably fitted within said upper end of said hollow cylindrical base; and a mouthpiece having a mouthpiece axis, and a lower end with at least one corrugation adapted to fittingly attach with said at least one corrugation of said upper end portion of said hollow connector;

wherein said ball and socket joint enables said mouthpiece to rotate about said hollow cylindrical base and for said mouthpiece axis to be moveably angled in direction relative to said axis of said hollow cylindrical base.

2. The mouthpiece set of a snorkel as recited in claim 1, wherein a clip is attached to said snorkel tube for attaching to a mask.

3. The mouthpiece set of a snorkel as recited in claim 1, wherein the position of components in said ball and socket joint is inverted; whereby the spherical portion is located on said upper end of said hollow base and the moveably fitted hollow cylindrical portion is located on said lower end of said hollow connector.

* * * * *